US008662033B2

(12) United States Patent
Gallon et al.

(10) Patent No.: US 8,662,033 B2
(45) Date of Patent: Mar. 4, 2014

(54) MODULAR ENGINE ASSEMBLY AND FLUID CONTROL ASSEMBLY FOR HYDRAULICALLY-ACTUATED MECHANISM

(75) Inventors: Robert Jack Gallon, Northville, MI (US); Alan W. Hayman, Romeo, MI (US); Eric C. Douse, Bloomfield Hills, MI (US); William F. Spruit, Grand Blanc, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 598 days.

(21) Appl. No.: 12/720,899

(22) Filed: Mar. 10, 2010

(65) Prior Publication Data

US 2011/0220055 A1 Sep. 15, 2011

(51) Int. Cl.

| | |
|---|---|
| ***F02F 11/00*** | (2006.01) |
| ***F02F 1/42*** | (2006.01) |
| ***F01L 9/02*** | (2006.01) |
| ***F01L 1/34*** | (2006.01) |
| ***F01M 1/06*** | (2006.01) |

(52) U.S. Cl.
USPC ..... 123/90.12; 123/90.15; 123/193.3; 123/193.5; 123/90.33

(58) Field of Classification Search
USPC ..... 123/90.12, 90.15, 90.16, 90.33, 188.9, 123/193.3, 193.5, 196 R; 29/888.01, 888.06
See application file for complete search history.

(56) References Cited

U.S. PATENT DOCUMENTS

| | | | | |
|---|---|---|---|---|
| 4,662,328 | A * | 5/1987 | Kronich | 123/198 C |
| 5,090,364 | A | 2/1992 | McCarroll et al. | |
| 5,127,375 | A * | 7/1992 | Bowman et al. | 123/90.12 |
| 5,143,034 | A * | 9/1992 | Hirose | 123/196 R |
| 5,423,295 | A * | 6/1995 | Murata et al. | 123/90.16 |
| 5,499,606 | A * | 3/1996 | Robnett et al. | 123/90.12 |
| 5,704,315 | A * | 1/1998 | Tsuchida et al. | 123/90.16 |
| 5,937,809 | A | 8/1999 | Pierik et al. | |
| 6,289,859 | B1 * | 9/2001 | Fujii et al. | 123/90.15 |
| 6,321,701 | B1 * | 11/2001 | Vorih et al. | 123/90.12 |
| 6,439,176 | B1 * | 8/2002 | Payne et al. | 123/90.12 |
| 6,467,445 | B1 | 10/2002 | Harris | |
| 6,817,325 | B2 * | 11/2004 | Dinkel et al. | 123/90.13 |
| 6,892,683 | B2 * | 5/2005 | Diehl et al. | 123/90.12 |
| 7,007,646 | B2 * | 3/2006 | Takayasu et al. | 123/90.16 |
| 7,194,990 | B2 * | 3/2007 | Sun | 123/90.12 |
| 7,464,677 | B2 | 12/2008 | Neal et al. | |
| 7,484,489 | B2 * | 2/2009 | Hong | 123/90.59 |
| 7,610,881 | B2 * | 11/2009 | Yudanov | 123/90.12 |
| 7,717,081 | B2 * | 5/2010 | Yamada | 123/196 R |

(Continued)

*Primary Examiner* — Lindsay Low
*Assistant Examiner* — Tea Holbrook
(74) *Attorney, Agent, or Firm* — Harness, Dickey & Pierce, P.L.C.

(57) ABSTRACT

An engine assembly may include a cylinder head and a fluid control assembly. The cylinder head may include first and second walls opposite one another and extending from a base region defining a cavity. The cylinder head may define a first oil passage extending through an interior surface defining the cavity. The fluid control assembly may include a first oil control valve and a first conduit. The first oil control valve may be fixed to the base region and may define a first port in fluid communication with the first oil passage and a second port in fluid communication with a second oil passage in the cylinder head. The first conduit may extend from the first oil control valve toward the first wall and may provide the fluid communication between the first port of the oil control valve and the first oil passage in the cylinder head.

20 Claims, 6 Drawing Sheets

(56) References Cited

U.S. PATENT DOCUMENTS

| | | | | |
|---|---|---|---|---|
| 7,942,118 | B2 * | 5/2011 | Baker | 123/90.16 |
| 8,051,820 | B2 * | 11/2011 | Shoji | 123/90.33 |
| 8,113,160 | B2 * | 2/2012 | Methley | 123/90.17 |
| 2003/0005902 | A1 * | 1/2003 | Tsukui et al. | 123/188.9 |
| 2006/0075980 | A1 * | 4/2006 | Kim et al. | 123/90.12 |
| 2008/0078342 | A1 * | 4/2008 | Hirayama et al. | 123/90.12 |
| 2008/0149055 | A1 * | 6/2008 | Canino et al. | 123/90.12 |
| 2008/0178828 | A1 * | 7/2008 | Patel et al. | 123/90.12 |
| 2008/0190386 | A1 * | 8/2008 | Raghavan et al. | 123/90.1 |
| 2008/0236520 | A1 * | 10/2008 | Maehara et al. | 123/52.1 |
| 2009/0217893 | A1 * | 9/2009 | Fujita | 123/90.12 |
| 2011/0120411 | A1 * | 5/2011 | Ren et al. | 123/321 |

* cited by examiner

MODULAR ENGINE ASSEMBLY AND FLUID CONTROL ASSEMBLY FOR HYDRAULICALLY-ACTUATED MECHANISM

FIELD

The present disclosure relates to internal combustion engines, and more specifically to fluid control systems for hydraulically-actuated mechanisms.

BACKGROUND

This section provides background information related to the present disclosure which is not necessarily prior art.

Internal combustion engines may combust a mixture of air and fuel in cylinders and thereby produce drive torque. Air and fuel flow into and out of the cylinders may be controlled by a valvetrain. The valvetrain may include hydraulically actuated variable valve lift mechanisms to selectively vary the amount of valve lift. Pressurized oil within the engine may be transmitted to the variable valve lift mechanisms via a system of interconnected fluid passages formed in the cylinder head. Cylinder heads with such an integrated hydraulic system typically are specific to engine systems including the variable valve lift mechanisms and are different than cylinder heads for the same engine systems that do not include variable valve lift mechanisms.

SUMMARY

An engine assembly may include a cylinder head and a fluid control assembly. The cylinder head may include first and second walls opposite one another and extending from a base region defining a cavity. The cylinder head may define a first oil passage extending through an interior surface defining the cavity. The fluid control assembly may include a first oil control valve and a first conduit. The first oil control valve may be fixed to the base region of the cylinder head and may define a first port in fluid communication with the first oil passage and a second port in fluid communication with a second oil passage in the cylinder head. The first conduit may extend from the first oil control valve toward the first wall of the cylinder head and may provide the fluid communication between the first port of the oil control valve and the first oil passage in the cylinder head.

An engine assembly method may include forming a plurality of cylinder heads, each including first and second walls opposite one another and extending from a base region to define a cavity with a first oil passage located in the cylinder head and isolated from the cavity. The method may further include forming a second oil passage through an interior surface of the cavity of a first of the cylinder heads. The second oil passage may intersect the first oil passage. A first engine assembly may be assembled including the first cylinder head.

Assembling the first engine assembly may include securing a first oil control valve to the base region of the first cylinder head and coupling a first conduit to the second oil passage in the first cylinder head and a first port in the first oil control valve to provide fluid communication between the second oil passage and the first oil control valve. The securing may provide fluid communication between a pressurized oil supply and a second port of the first oil control valve. The coupling may include the first conduit extending from the first oil control valve toward the first wall.

A first valve lift mechanism may be mounted within the cavity and in fluid communication with the first oil passage.

The first valve lift mechanism may be switchable from a first mode providing a first lift duration to a second mode providing a second valve lift duration different from the first valve lift duration when the first oil control valve provides communication between the pressurized oil supply and the first oil passage.

A second engine assembly may be assembled including a second of the cylinder heads without providing communication between the first oil passage and the cavity via the second oil passage. Assembly of the second engine assembly may include mounting a second valve lift mechanism within the cavity.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

Corresponding reference numerals indicate corresponding parts throughout the several views of the drawings.

DETAILED DESCRIPTION

Figure 1:
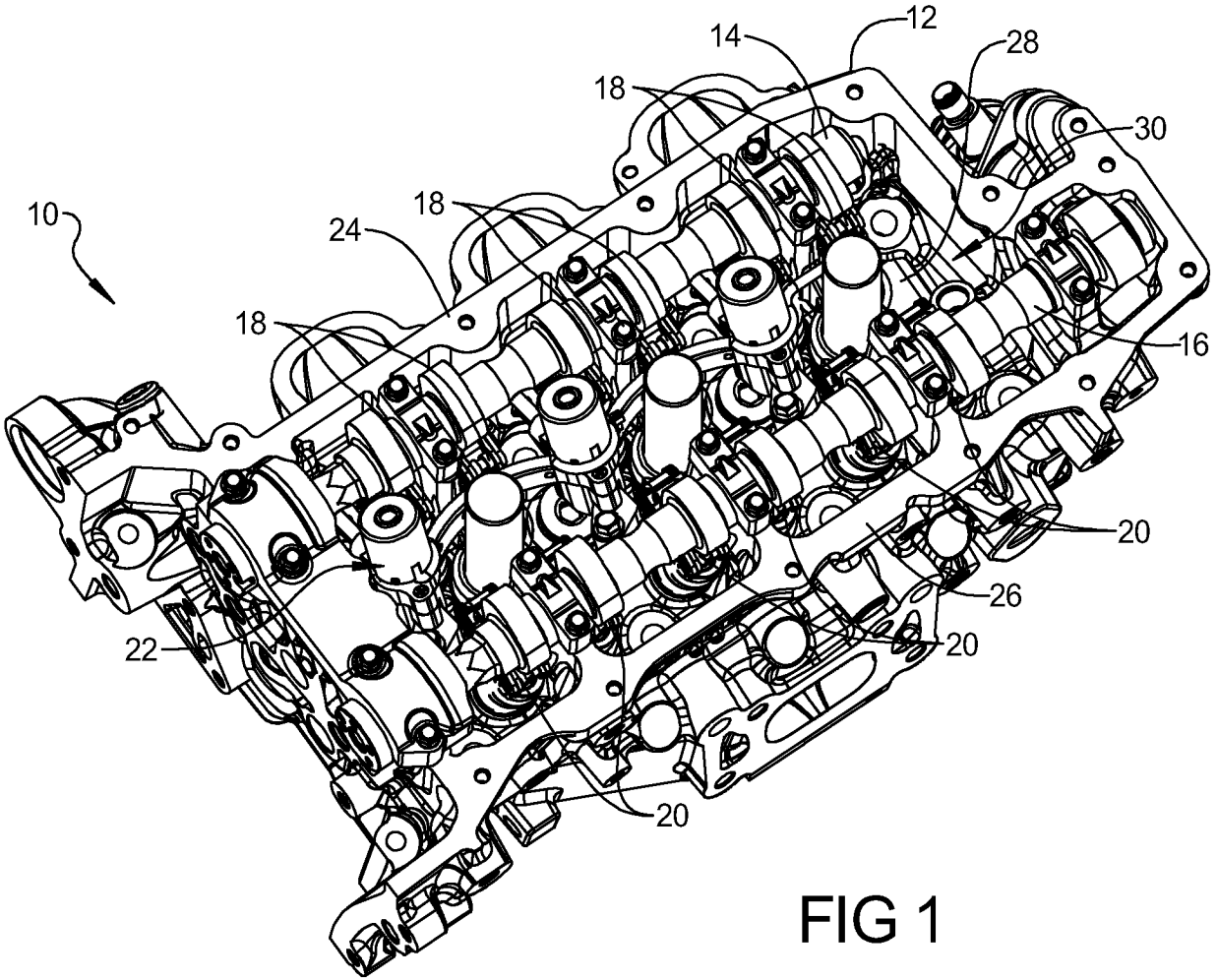
FIG. 1 is a perspective view of an engine assembly including an exemplary cylinder head according to the present disclosure.

The following description is merely exemplary in nature and is not intended to limit the present disclosure, application, or uses. It should be understood that throughout the drawings, corresponding reference numerals indicate like or corresponding parts and features.

Figure 2:
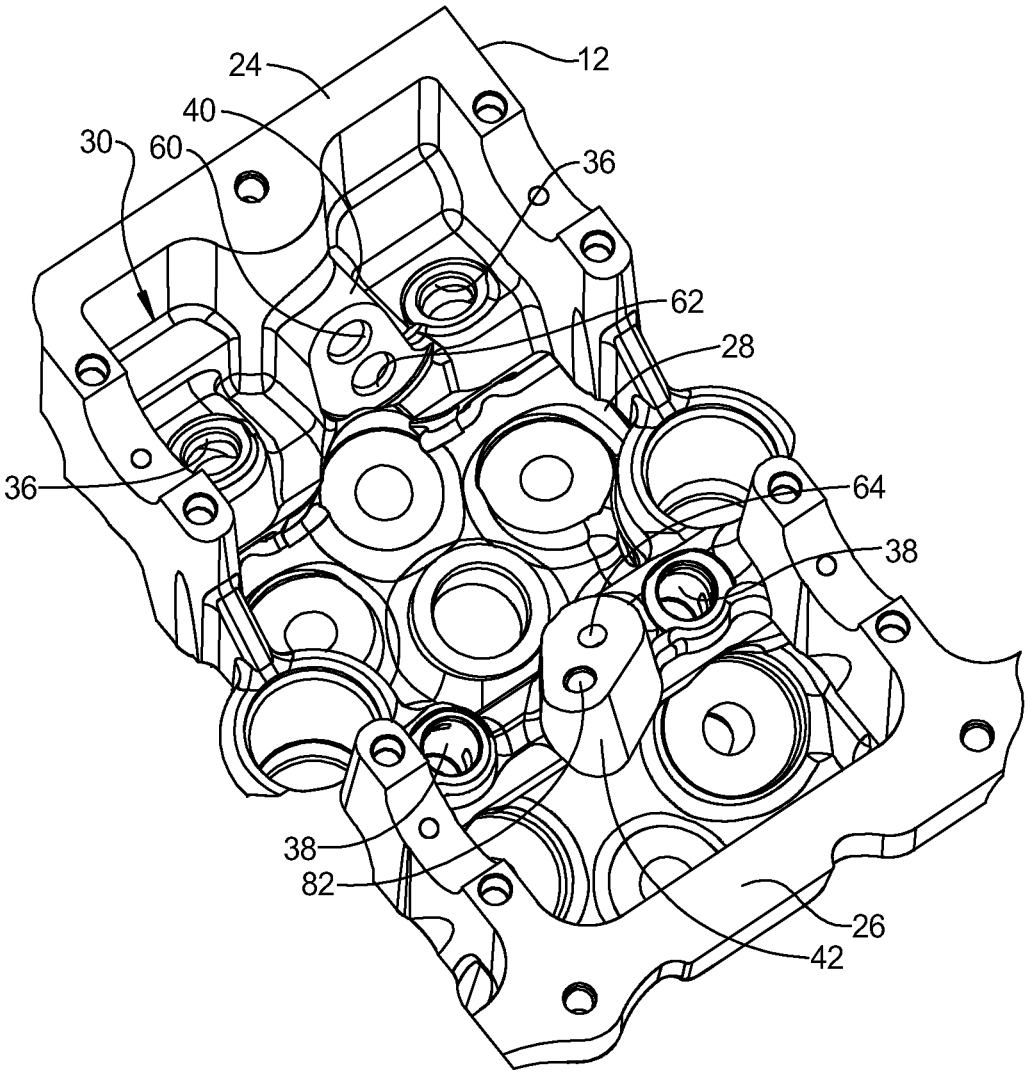
FIG. 2 is a fragmentary perspective view of the cylinder head of FIG. 1.

With reference to FIGS. 1 and 2, an exemplary engine assembly 10 is illustrated. The engine assembly 10 may include a cylinder head 12, first and second camshafts 14, 16, first and second valve lift mechanisms 18, and a hydraulic fluid control assembly 22. The cylinder head 12 may rotationally support the first and second camshafts 14, 16 and may support the first and second valve lift mechanisms 18, 20 engaged with lobes of the first and second camshafts 14, 16, respectively. In the present non-limiting example, the first camshaft is an intake camshaft, the second camshaft 16 is an exhaust camshaft, the first valve lift mechanism 18 is an intake valve lift mechanism and the second valve lift mechanism 20 is an exhaust valve lift mechanism. However, it is understood that the present disclosure is not limited to such arrangements.

The cylinder head 12 may include first and second walls 24, 26 extending from a base region 28 and defining a cavity 30. The intake and exhaust camshafts 14, 16, intake and exhaust valve lift mechanisms 18, 20 and fluid control assembly 22 may be located within the cavity 30. With reference to FIGS.

2 and 5, the cylinder head 12 may define a primary cylinder head oil supply passage 32 (FIG. 5), a secondary cylinder head oil supply passage 34 (FIG. 5), mounting bores 36, 38 (FIG. 2) for the intake and exhaust valve lift assemblies 18, 20, and first and second mounting regions 40, 42 (FIG. 2) for engagement with the hydraulic fluid control assembly 22. The primary cylinder head oil supply passage 32 may be in communication with the first and second valve lift assemblies 18, 20 via the mounting bores 36, 38. In the present non-limiting example, the mounting bores 36, 38 house the hydraulic lash adjusters (not shown) providing fluid communication between the first and second valve lift assemblies 18, 20 and the primary cylinder head oil supply passage 32.

The cylinder head 12 may additionally define a first set of passages 44, 46, 48 (FIG. 5) and a second set of passages 50, 52, 54 (FIG. 5) in the in the base region 28. Each of the passages 44, 46, 48 may be isolated from one another and each of the passages 50, 52, 54 may be isolated from one another. Each of the passages 44, 46, 48 may be in communication with a pair of the mounting bores 36 associated with a cylinder of the engine assembly 10 and each of the passages 50, 52, 54 may be in communication with a pair of the mounting bores 38 associated with a cylinder of the engine assembly 10. The first set of passages 44, 46, 48 may be located below the first camshaft 14 and the second set of passages 50, 52, 54 may be located below the second camshaft 16.

An oil pump 56 may provide pressurized oil to the primary cylinder head oil supply passage 32 and the secondary cylinder head oil supply passage 34. The primary cylinder head oil supply passage 32 may include a pressure reducing mechanism 58, such as an orifice. Therefore, the secondary cylinder head oil supply passage 34 may include oil at a pressure greater than the pressure of the oil within the primary cylinder head oil supply passage 32.

Figure 5:
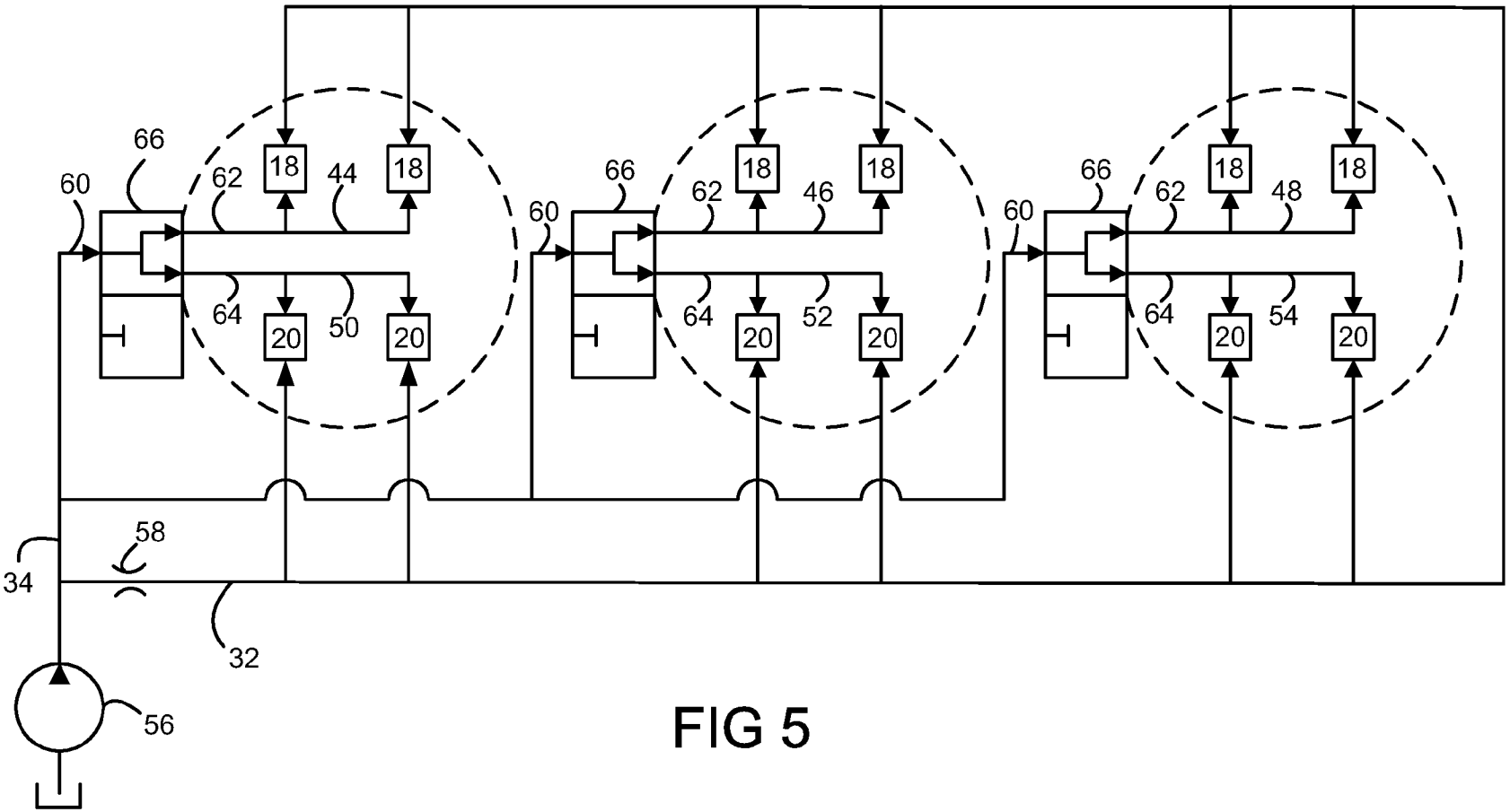
FIG. 5 is a schematic diagram illustrating a first oil flow arrangement according to the present disclosure.

In a first arrangement, illustrated in FIGS. 2 and 5, the first and/or second valve lift assemblies 18, 20 may form variable valve lift mechanisms. By way of non-limiting example, the variable valve lift mechanisms may be switchable between first and second modes based on pressurized oil controlled by the hydraulic fluid control assembly 22. The first mode may provide a first valve lift that is different than a second valve lift provided during the second mode. The difference in valve lift may include varying valve lift height and/or duration. By way of non-limiting example, the second lift mode may include a deactivated lift mode when engagement of the variable valve lift mechanism by a camshaft lobe does not result in valve opening.

In the arrangement of FIGS. 2 and 5, the cylinder head 12 may additionally include first and second oil passages 60, 62 extending through the first mounting regions 40 and third oil passages 64 extending through the second mounting regions 42. In the present non-limiting example, the first mounting regions 40 are located on the first wall 24 and the second mounting regions 42 are located on the base region 28. Therefore, the first and second oil passages 60, 62 may extend through the interior surface of the first wall 24 and the third oil passage 64 may extend through the interior surface of the base region 28. The first oil passages 60 may be in fluid communication with the secondary cylinder head oil supply passage 34, the second oil passages 62 may each be in fluid communication with one of the first set of passages 44, 46, 48 and the third oil passages 64 may each be in fluid communication with one of the second set of oil supply passages 50, 52, 54.

Figure 3:
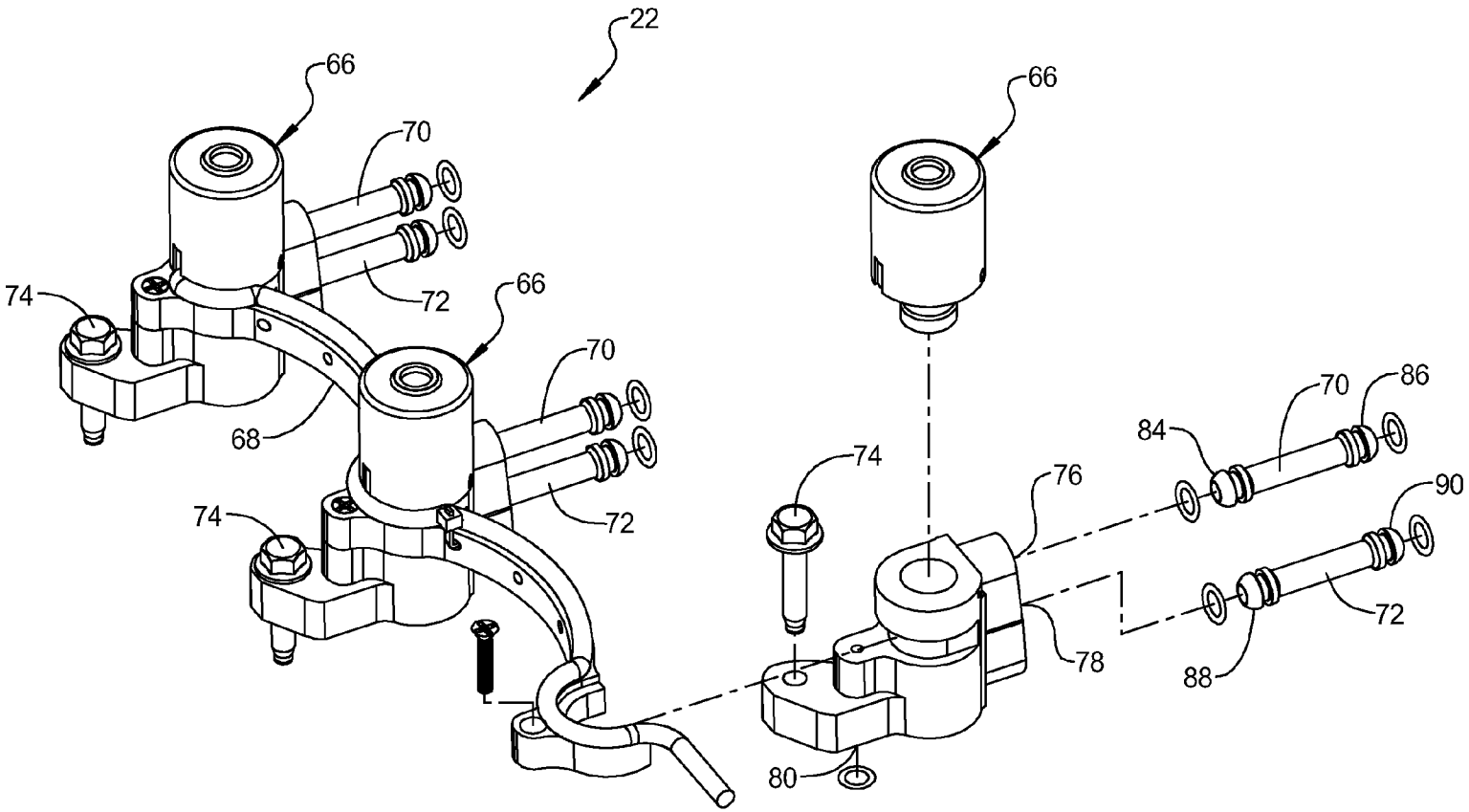
FIG. 3 is a partially exploded perspective view of an exemplary fluid control assembly according to the present disclosure.
Figure 4:
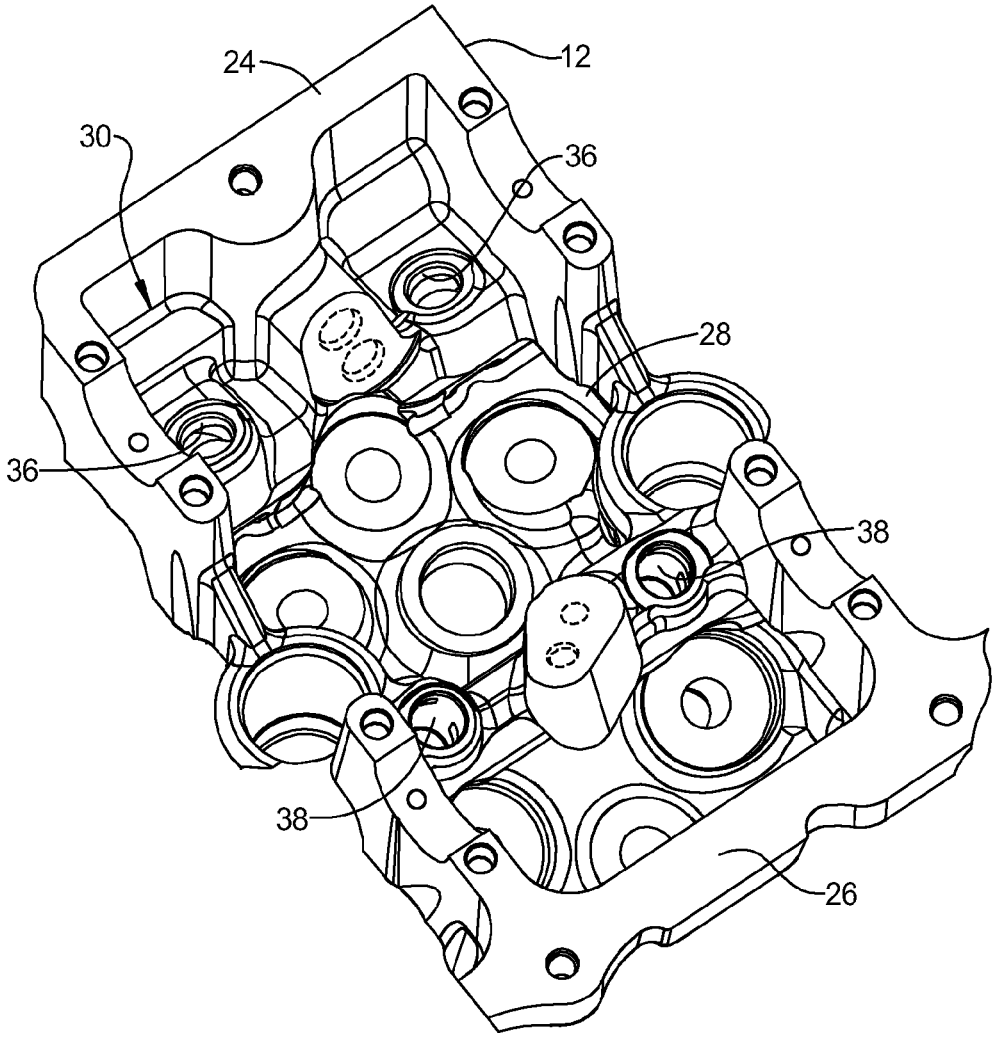
FIG. 4 is a fragmentary perspective view of an alternate cylinder head according to the present disclosure.

The pressurized oil flow to the first and second valve lift mechanisms 18, 20 may be controlled by the hydraulic fluid control assembly 22 to control operation in the first and second modes. Due to the flow path arrangement discussed above, the first and second valve lift mechanisms 18, 20 for a given cylinder may be controlled independently from the first and second valve lift mechanisms 18, 20 associated with the other cylinders. With reference to FIGS. 3 and 4, the hydraulic fluid control assembly 22 may include oil control valves 66, a mounting bracket 68, first and second conduits 70, 72 and fasteners 74. Each of the oil control valves 66 and first and second conduits 70, 72 may be similar. Therefore, a single oil control valve 66, first conduit 70 and second conduit 72 will be described.

The oil control valve 66 may include an inlet port 76 and first and second outlet ports 78, 80. The oil control valve 66 may be fixed to the cylinder head 12 by the bracket 68. In the present non-limiting example, the oil control valves 66 may be fixed to the bracket 68 and the bracket 68 may be secured to the base region 28 of the cylinder head 12 by the fasteners 74 being in threaded engagement with threaded bores 82 (FIG. 2) in the second mounting regions 42.

A lower surface of the oil control valve 66 may abut the second mounting region 42 and provide sealed fluid communication between the second outlet port 80 and the third oil passage 64. The first conduit 70 may extend between the first wall 24 of the cylinder head 12 and the oil control valve 66 and may include a first end 84 in fluid communication with the inlet port 76 and a second end 86 in fluid communication with the first oil passage 60. The second conduit 70 may extend between the first wall 24 of the cylinder head 12 and the oil control valve 66 and may include a first end 88 in fluid communication with the first outlet port 78 and a second end 90 in fluid communication with the second oil passage 62. The first and second conduits 70, 72 may extend between the base region 28 of the cylinder head 12 and the first camshaft 14. The first and second conduits 70, 72 may form flexible tubes having bore seals engaged with the cylinder head 12 and the oil control valve 66 to account for positional deviation of the hydraulic fluid control assembly 22 due to assembly tolerances. The arrangement of the hydraulic fluid control assembly 22 provides for removal of its various components for service without the need to remove the cylinder head 12 from the engine assembly 10 or the need to remove the first and second camshafts 14, 16.

Figure 6:
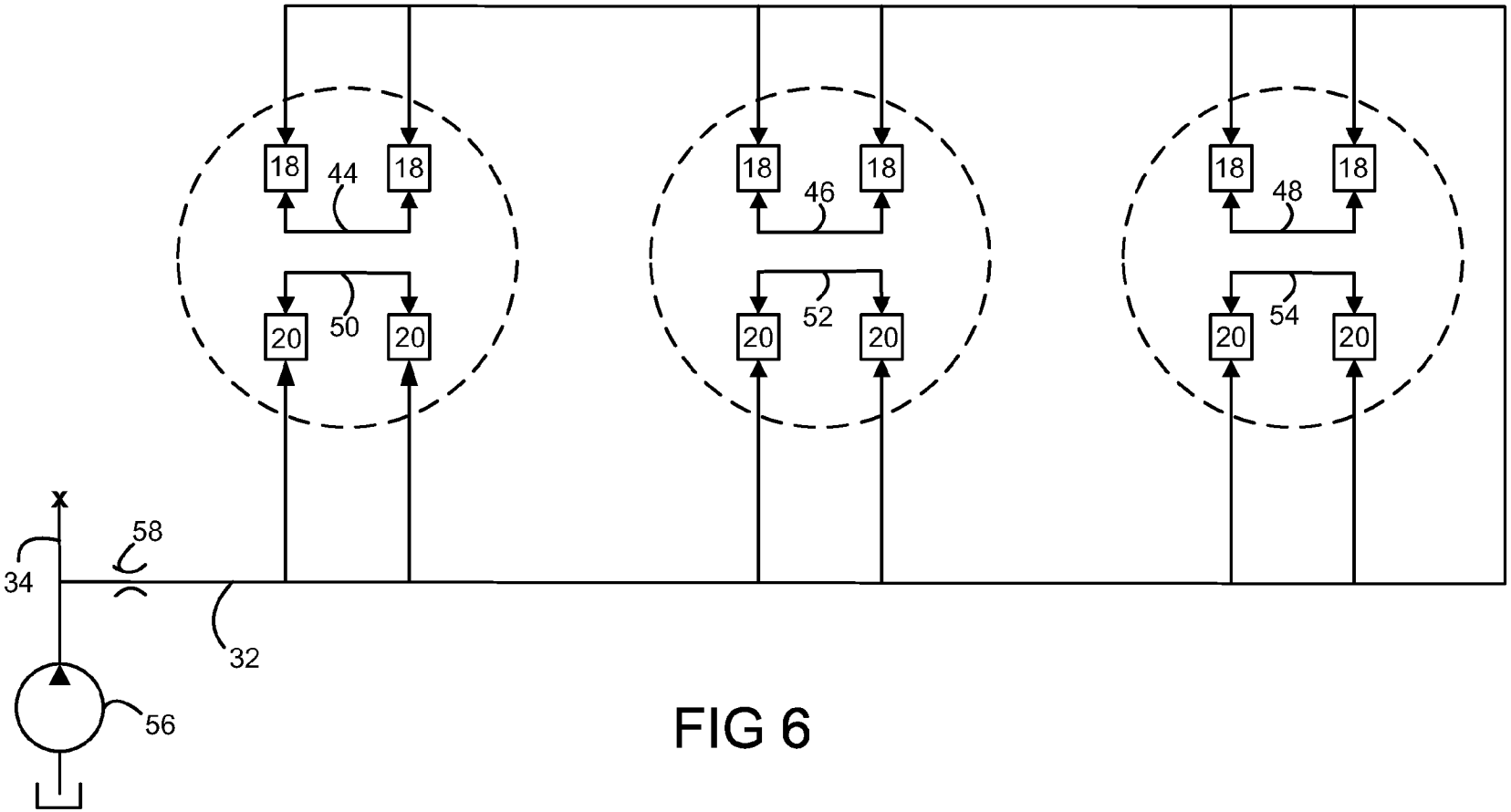
FIG. 6 is a schematic diagram illustrating a second oil flow arrangement according to the present disclosure.

FIGS. 4 and 6 illustrate the cylinder head 12 in an initial state during assembly. As seen in FIGS. 4 and 6, the cylinder head 12 may initially include the primary cylinder head oil supply passage 32, the first set of passages 44, 46, 48 and the second set of passages 50, 52, 54. The cylinder head 12 in the initial state may be used for assembly of engines without the hydraulic fluid control assembly 22 for arrangements where the first and second valve lift assemblies 18, 20 are traditional valve lift mechanisms (i.e., not variable valve lift mechanisms). In the initial state, the first set of passages 44, 46, 48 and the second set of passages 50, 52, 54 may form dead volumes.

However, since the first set of passages 44, 46, 48 and the second set of passages 50, 52, 54 are present in the initial state, a common cylinder head can be used for both traditional (non-variable lift) arrangements and arrangements including the variable valve lift mechanisms and the hydraulic fluid control assembly 22 discussed above. In applications including the variable valve lift mechanisms, the secondary cylinder head oil supply passage 34 and the first, second and third oil passages 60, 62, 64 may be formed in the cylinder head 12. The forming may include machining bores through the interior surface of the cavity 32 defined by the cylinder head 12. The addition of the secondary cylinder head oil supply passage 34 and the first, second and third oil passages 60, 62, 64 provides a high pressure oil supply to the hydraulic fluid control assembly 22 and provide a flow path from the hydraulic fluid control assembly 22 to the first and second lift mechanisms 18, 20.

The first and second camshafts 14, 16 and the hydraulic fluid control assembly 22 may be coupled to the cylinder head 12 before the cylinder head 12 is coupled to an engine block (not shown) of the engine assembly 10. The hydraulic fluid control assembly 22 may be coupled to the cylinder head 12 after the first and second camshafts 14, 16 are coupled to the cylinder head 12, and more specifically after the cylinder head 12 is coupled to the engine block.

Alternatively, the secondary cylinder head oil supply passage 34 may be present in the initial state. In such an arrangement, the secondary cylinder head oil supply passage 34 also forms a dead volume, due to the absence of the first oil passages 60 from the cylinder head 12 in the initial state.

It is understood that traditional (non-variable lift) arrangement may include the cast structure of the cylinder 12 being free from additional machining (defining a cast wall structure after engine assembly) to isolate the first and second lift mechanisms from the high pressure oil supply. Alternatively, the secondary cylinder head oil supply passage 34 and the first, second and third oil passages 60, 62, 64 may be formed in the cylinder head 12 and then plugged.

As discussed above, the features of the cylinder head 12 provide for production of a plurality of common cylinder heads 12 (in the initial state) which can later be used for either variable valve lift applications or traditional fixed lift applications. It is understood that while discussed in combination with a variable valve lift arrangement, the present disclosure applies equally to arrangements including other hydraulically-actuated engine components.

The terms "first", "second", etc. are used throughout the description for clarity only and are not intended to limit similar terms in the claims.

What is claimed is:

1. An engine assembly comprising:

a cylinder head (12) including first and second walls (24, 26) opposite one another and extending from a base region (28) defining a cavity (30), the cylinder head (12) defining a first oil passage (34, 60) extending through an interior surface defining the cavity (30); and a fluid control assembly (22) including:

a first oil control valve (66) fixed to the base region (28) of the cylinder head (12) and defining a first port (76) coupled with the first oil passage (34, 60) and a second port (78) coupled with a second oil passage (62) in the cylinder head (12); and a first conduit (70) extending from the first oil control valve (66) toward the first wall (24) of the cylinder head (12) and providing the fluid communication between the first port (76) of the first oil control valve (66) and the first oil passage (34, 60) in the cylinder head (12).

2. The engine assembly of claim 1, further comprising a first camshaft (14) supported on the cylinder head (12) between the first oil control valve (66) and the first wall (24).

3. The engine assembly of claim 2, wherein the first conduit (70) extends between the first camshaft (14) and the base region (28) of the cylinder head (12).

4. The engine assembly of claim 2, further comprising a first valve lift mechanism (18) supported on the cylinder head (12), engaged with the first camshaft (14) and in fluid communication with the first conduit (70), the first valve lift mechanism (18) switchable from a first mode providing a first valve lift duration to a second mode providing a second valve lift duration different from the first valve lift duration when pressurized oil is provided to the first conduit (70) by the first oil control valve (66).

5. The engine assembly of claim 4, further comprising a second valve lift mechanism (18) supported on the cylinder head (12) and engaged with the first camshaft (14), the first valve lift mechanism (18) associated with a first engine cylinder and the second valve lift mechanism (18) associated with a second engine cylinder, the fluid control assembly (22) including a second oil control valve (66) fixed to the base region (28) of the cylinder head (12) and including a second conduit (70) extending from the second oil control valve (66) toward the first wall (24) of the cylinder head (12), the second conduit (70) providing fluid communication between the second valve lift mechanism (18) and the second oil control valve (66) to switch the second valve lift mechanism between the first and second modes.

6. The engine assembly of claim 2, further comprising a second camshaft (16) supported on the cylinder head (12), the first oil control valve (66) being located between the first and second camshafts (14, 16).

7. The engine assembly of claim 6, wherein the first oil control valve (66) includes a third port (80) in communication with a third oil passage (64) in the cylinder head (14), wherein the second oil passage (62) defines an oil supply to the first oil control valve (66), the first oil passage (60) defines an oil supply from the first oil control valve (66) to a first valve lift mechanism (18) engaged with the first camshaft (14) and the third oil passage (64) defines an oil supply from the first oil control valve (66) to a second valve lift mechanism (20) engaged with the second camshaft (16).

8. The engine assembly of claim 1, wherein the first port (76) is an outlet port.

9. The engine assembly of claim 1, wherein the second oil passage (64) in the cylinder head (12) extends through a surface defined by the base region (28).

10. The engine assembly of claim 9, wherein the first oil control valve (66) is mounted on the surface (28).

11. A method comprising:

forming a plurality of identical cylinder heads (12), each including first and second walls (24, 26) opposite one another and extending from a base region (28) to define a cavity (30) with a first oil passage (34) located in the cylinder heads and isolated from the cavity (30);

forming a second oil passage (60) through an interior surface of the cavity of a first of the cylinder heads, the forming including the second oil passage (60) intersecting the first oil passage (34);

assembling a first engine assembly including the first of the cylinder heads (12), the assembling including:

securing a first oil control valve (66) to the base region (28) of the first of the cylinder heads (12) and coupling a first conduit (70) to the second oil passage (60) in the first of the cylinder heads (12) and a first port (76) in the first oil control valve (66) to provide fluid communication between the second oil passage (60) and the first oil control valve (66), the securing providing fluid communication between a third oil passage (64) through an interior surface of the cavity (30) and a second port (80) of the first oil control valve (66), the coupling including the first conduit (70) extending from the first oil control valve (66) toward the first wall (24);

mounting a first valve lift mechanism (18) within the cavity (30) and in fluid communication with the first oil control valve (66), the first valve lift mechanism (18) being switchable from a first mode providing a first valve lift duration to a second mode providing a second valve lift duration different from the first valve lift duration when the first oil control valve (66) provides communication between the second oil passage and the first valve lift assembly; and assembling a second engine assembly including a second of the cylinder heads (12) without providing communication between the first oil passage (34) and the cavity via the second oil passage (60) and mounting a second valve lift mechanism within the cavity.

12. The method of claim 11, wherein the forming the second oil passage (60) includes machining the second oil passage (60) through an interior surface of the first wall (24).

13. The method of claim 12, wherein the assembling the second engine assembly includes maintaining a cast wall structure in the second of the cylinder heads after engine assembly at a location between the first oil passage (34) and the interior surface defining the cavity (30) where the second oil passage is formed in the first of the cylinder heads.

14. The method of claim 12, wherein the assembling the second engine assembly includes forming the second oil passage (60) in the second of the cylinder heads and plugging the second oil passage (60).

15. The method of claim 11, wherein the plurality of cylinder heads include a fourth oil passage (44) isolated from the cavity and further comprising:

forming the third oil passage (62) through an interior surface of the first of the cylinder heads (12) defining the cavity and intersecting the fourth oil passage; and assembling the second engine assembly without providing communication between the fourth oil passage (44) and the cavity via the third oil passage (62).

16. The method of claim 15, wherein the fourth oil passage (44) is located proximate the first wall and the third oil passage (62) extends through the interior surface of the first wall (24).

17. The method of claim 16, wherein the assembling the first engine assembly includes coupling a second conduit to the third oil passage (62) in the first wall (24) and a third port (78) in the first oil control valve (66) to provide fluid communication between the third oil passage and the first oil control valve (66).

18. The method of claim 17, wherein the plurality of cylinder heads include a fifth oil passage (50) isolated from the cavity (30) and further comprising:

forming a sixth oil passage (64) through an interior surface of the base region (28) of the first cylinder head (12) defining the cavity and intersecting the fifth oil passage (50), the sixth oil passage (64) providing fluid communication between the first oil control valve (66) and the fifth oil passage (50); and assembling the second engine assembly without providing communication between the fifth oil passage (50) and the cavity (30) via the sixth oil passage (64).

19. The method of claim 18, wherein the coupling the first conduit (70) to the second oil passage (60) includes locating the first conduit (20) between the first camshaft (14) and the base region (28) of the first of the cylinder heads (12).

20. The method of claim 11, further comprising securing a first camshaft (14) to the first of the cylinder heads (12) before securing the first oil control valve (66) to the base region (28) of the first of the cylinder heads (12).

* * * * *